US008018397B2

(12) United States Patent
Jow et al.

(10) Patent No.: US 8,018,397 B2
(45) **Date of Patent: *Sep. 13, 2011**

(54) HIGH DIELECTRIC ANTENNA SUBSTRATE AND ANTENNA THEREOF

(75) Inventors: Uei-Ming Jow, Hsinchu (TW); Chang-Sheng Chen, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 460 days.

This patent is subject to a terminal disclaimer.

(21) Appl. No.: 12/234,427

(22) Filed: Sep. 19, 2008

(65) Prior Publication Data

US 2009/0015488 A1 Jan. 15, 2009

Related U.S. Application Data

(63) Continuation-in-part of application No. 11/555,107, filed on Oct. 31, 2006, now Pat. No. 7,446,711.

(30) Foreign Application Priority Data

Dec. 30, 2005 (TW) ..... 94147751 A

(51) Int. Cl.
*H01Q 15/02* (2006.01)
*H01Q 1/38* (2006.01)

(52) U.S. Cl. ..... 343/911 R; 343/700 MS

(58) Field of Classification Search ..... 343/700 MS, 343/911 R, 702, 846
See application file for complete search history.

(56) References Cited

U.S. PATENT DOCUMENTS

| | | | | |
|---|---|---|---|---|
| 5,541,399 | A | 7/1996 | de Vall | |
| 5,767,817 | A | 6/1998 | Tsuru et al. | |
| 5,870,057 | A | 2/1999 | Evans et al. | |
| 5,880,694 | A | 3/1999 | Wang et al. | |
| 5,926,136 | A | 7/1999 | Ohtsuka et al. | |
| 6,522,308 | B1 | 2/2003 | Mathieu | |
| 6,819,287 | B2 | 11/2004 | Sullivan et al. | |
| 6,885,341 | B2 | 4/2005 | Tran et al. | |
| 7,280,009 | B2 * | 10/2007 | Reynolds et al. | 333/202 |

FOREIGN PATENT DOCUMENTS

| | | |
|---|---|---|
| JP | 6268436 A | 9/1994 |
| JP | 2003-174211 | 6/2003 |
| TW | 554571 | 9/2003 |
| TW | 558077 | 10/2003 |
| WO | 2005101574 A1 | 10/2005 |

OTHER PUBLICATIONS

SIPO; Office Action in related foreign application (200610000269); mailed Aug. 3, 2010.

* cited by examiner

*Primary Examiner* — Hoang V Nguyen
(74) *Attorney, Agent, or Firm* — Workman Nydegger

(57) ABSTRACT

A high dielectric antenna substrate includes a first dielectric layer having a first dielectric constant, and a second dielectric layer having a second dielectric constant. The second dielectric layer is formed on one surface of the first dielectric layer. The second dielectric constant is lower than the first dielectric constant. Furthermore, a first metal layer and a second metal layer are optionally formed on the same surface or two surfaces of the first dielectric layer to compose a capacitor.

27 Claims, 14 Drawing Sheets

HIGH DIELECTRIC ANTENNA SUBSTRATE AND ANTENNA THEREOF

CROSS-REFERENCE TO RELATED APPLICATIONS

This application is a continuation-in-part patent application of U.S. application Ser. No. 11/555,107 filed on Oct. 31, 2006, the entire contents of which are hereby incorporated by reference for which priority is claimed under 35 U.S.C. §120. U.S. application Ser. No. 11/555,107 claims priority to Taiwanese application No. 094147751, filed Dec. 30, 2005.

BACKGROUND OF THE INVENTION

1. Field of Invention

The present invention relates to a substrate antenna, and more particularly, to a high dielectric inorganic substrate antenna.

2. Related Art

Wireless communication technology is accomplished through electromagnetic wave radiation. The generation of electromagnetic waves is substantially a transformation process between an electric field and a magnetic field, so that energy is transferred in space in the form of a wave. The existence of an antenna provides an environment for the changing of the electric field, and the geometric shape of the antenna determines the oscillation space for the electric field. Generally speaking, materials capable of generating an antenna effect are mainly metals.

Due to the rapid development of wireless communication technology and semiconductor manufacturing processes in recent years, wireless communication has become an essential part of modern life. Meanwhile, the global communication market is accordingly highly developed. The wireless communication system includes a transceiver and an antenna. The antenna is used for electromagnetic energy conversion between the circuit and the air, and is an indispensable piece of basic equipment for communication systems. Current antenna design is focusing on miniaturization, structure simplification, and multi-band or broadband.

In antenna-related circuit design, sometimes the capacitor, inductor, or other passive components are used for circuit matching. However, with the trend of electronic products becoming light, thin, short, and small, the components for electronic products must also consider this trend in design.

An antenna structure disclosed in U.S. Pat. No. 5,541,399 is an antenna with the multi-band resonance being achieved by a coupling capacitor with a winding structure, and the antenna is further disposed with a discrete capacitor for circuit matching. However, the installation of the discrete capacitor increases the cost, and the capacitance coupling magnitude of a coil for an ordinary substrate is limited.

As for an antenna structure disclosed in U.S. Pat. No. 6,885,341, the antenna effect is enhanced by using a ferroelectric material, and discrete surface mount devices are used for the circuit matching. However, the manufacturing cost is increased by the ferroelectric embedment.

As for the conventional antenna design, since the capacitor is externally disposed, the assembly cost and material cost are unavoidably increased. Therefore, if the passive component, such as the capacitor, of the antenna is varied to be combined with the antenna in another form, the flexibility of the antenna design can be enhanced. Furthermore, at present, multi-band or broadband is the main direction of technological development of the antenna.

SUMMARY OF THE INVENTION

The invention discloses a high dielectric antenna substrate and the antenna thereof.

A high dielectric antenna substrate of the present invention comprises a first dielectric layer, a second dielectric layer, and a substrate. The first dielectric layer has a first dielectric constant. The second dielectric layer formed on one surface of the first dielectric layer has a second dielectric constant. The second dielectric constant is lower than the first dielectric constant. The substrate formed on the other surface of the first dielectric layer is an inorganic material substrate.

A high dielectric antenna substrate of the present invention comprises two first dielectric layers, two second dielectric layers, and a substrate. The two first dielectric layers have a first dielectric constant respectively, wherein one surface of each first dielectric layer contacts with each other. The two second dielectric layers have a second dielectric constant, and are formed on one surface of each first dielectric layer respectively. The second dielectric constant is lower than the first dielectric constant. The substrate formed between the two first dielectric layers is an inorganic material substrate.

A high dielectric antenna substrate of the present invention comprises a first dielectric layer having a first dielectric constant, a first metal layer formed on one surface of the first dielectric layer, a second metal layer formed on the other surface of the first dielectric layer, a second dielectric layer having a second dielectric constant lower than the first dielectric constant, and a substrate. The second dielectric layer is formed on one surface of the first metal layer. The first metal layer and the second metal layer form a capacitor. The substrate formed on the other surface of the first metal layer is an inorganic material substrate.

A high dielectric antenna substrate of the present invention comprises a first dielectric layer having a first dielectric constant, a first metal layer and a second metal layer formed on the same surface of the first dielectric layer, a second dielectric layer having a second dielectric constant lower than the first dielectric constant and a substrate. The second dielectric layer is formed on one surface of the first metal layer. The first metal layer and the second metal layer form a capacitor. The substrate formed on the other surface of the first dielectric layer is an inorganic material substrate.

A high dielectric antenna substrate of the present invention comprises two first dielectric layers having a first dielectric constant respectively, two first metal layers, two second metal layers, two second dielectric layers, having a second dielectric constant lower than the first dielectric constant, formed on the other surface of the second metal layer respectively, and a substrate. One of the first metal layers and one of the second metal layers are formed on two surfaces of one of the first dielectric layers to compose a capacitor; and the other one of the first metal layers and the other one of the second metal layers are formed on two surfaces of the other one of the first dielectric layers, to compose a capacitor. The substrate formed between the two first dielectric layers is an inorganic material substrate.

A high dielectric antenna substrate of the present invention comprises two first dielectric layers having a first dielectric constant respectively, two first metal layers, two second metal layers, two second dielectric layers, having a second dielectric constant lower than the first dielectric constant, formed on the other surface of the second metal layer respectively, and a substrate. One of the first metal layers and one of the second metal layers are formed on the same surface of one of the first dielectric layers, to compose a capacitor; and the other one of the first metal layers and the other one of the second metal layers are formed on the same surface of the other one of the first dielectric layers, to compose a capacitor. The substrate formed between the two first dielectric layers is an inorganic material substrate.

An antenna module of the present invention comprises a first dielectric layer having a first dielectric constant, a second dielectric layer having a second dielectric constant lower than the first dielectric constant, an antenna formed on the other surface of the second dielectric layer, and a substrate. The second dielectric layer is formed on one surface of the first dielectric layer. The substrate, formed on the other surface of the first dielectric layer, is an inorganic material substrate.

An antenna module of the present invention comprises two first dielectric layers having a first dielectric constant respectively, two second dielectric layers having a second dielectric constant lower than the first dielectric constant, and at least one antenna, formed on one surface of each second dielectric layer, and a substrate. The substrate formed between the two first dielectric layers is an inorganic material substrate.

An antenna module of the present invention comprises a first dielectric layer having a first dielectric constant, a first metal layer and a second metal layer, formed on two surfaces of the first dielectric layer respectively, to compose a capacitor, a second dielectric layer having a second dielectric constant lower than the first dielectric constant, an antenna formed on the other surface of the second dielectric layer; and a substrate. The second dielectric layer is formed on one surface of the first metal layer. The substrate, formed on the other surface of the second metal layer, is an inorganic material substrate.

An antenna module of the present invention comprises two first dielectric layers having a first dielectric constant respectively, two first metal layers and two second metal layers, two second dielectric layers, having a second dielectric constant lower than the first dielectric constant, formed on the other surface of the second metal layer respectively, a substrate, and at least one antenna formed on the other surface of the second dielectric layer. One of the first metal layers and one of the second metal layers are formed on two surfaces of one of the first dielectric layers, to compose a capacitor; and the other one of the first metal layers and the other one of the second metal layers are formed on two surfaces of the other one of the first dielectric layers, to compose a capacitor. The substrate, formed between the two first metal layers, is an inorganic material substrate.

According to the embodiments of the present invention, by using a high dielectric material, the antenna area can be reduced, the material cost can be saved, and the assembly cost can be decreased.

According to the embodiments of the present invention, the capacitor is embedded within the substrate. As many optional capacitances can be designed with the embedded capacitor, the antenna structure is not limited to employing a chip capacitor, such that the design is more flexible.

According to the embodiments of the present invention, the high dielectric substrate can be used to further shorten a wavelength of the microwave radiation, so as to miniaturize the antenna size.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, and which thus is not limitative of the present invention, and wherein.

DETAILED DESCRIPTION OF THE INVENTION

The detailed features and advantages of the present invention are illustrated below in details in the detailed description, which is sufficient for those skilled in the related arts to understand the technical content of the present invention and to implement the present invention accordingly. Those skilled in the art can easily appreciate the objects and advantages related to the present invention through the content, claims, and drawings in this specification.

Figure 1:
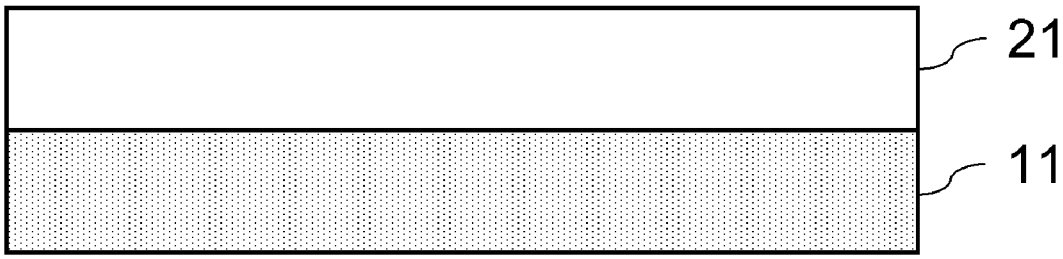
FIG. 1 is a schematic structural diagram of a high dielectric antenna substrate according to a first embodiment of the present invention.

FIG. 1 is a schematic structural diagram of a high dielectric antenna substrate according to the first embodiment of the present invention. As shown in FIG. 1, the antenna substrate is a composite substrate including a first dielectric layer 11 and a second dielectric layer 21. The first dielectric layer 11 is made of a high dielectric material and has a first dielectric constant. The second dielectric layer 21 having a second dielectric constant formed on one surface of the first dielectric layer 11. The second dielectric constant of the second dielectric layer 21 is lower than the first dielectric constant of the first dielectric layer 11.

Figure 2:
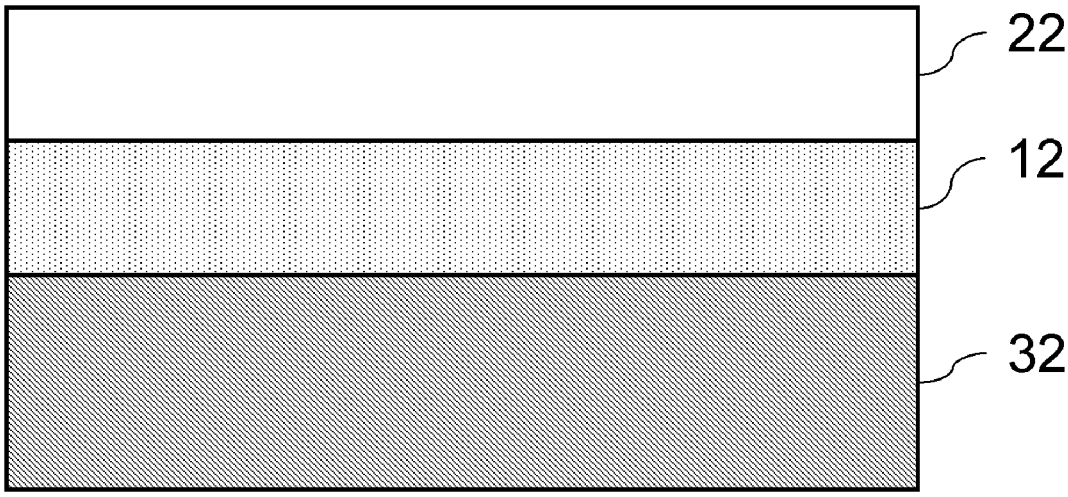
FIG. 2 is a schematic structural diagram of the high dielectric antenna substrate according to a second embodiment of the present invention.

Referring to FIG. 2, it is a schematic structural diagram of the high dielectric antenna substrate according to the second embodiment of the present invention. As shown in FIG. 2, the antenna substrate is a composite substrate including a first dielectric layer 12 and a second dielectric layer 22. The first dielectric layer 12 is made of a high dielectric material and has a first dielectric constant. The second dielectric layer 22 having a second dielectric constant formed on one surface of the first dielectric layer 12. It further comprises a substrate 32, formed on the other surface of the first dielectric layer 12. The substrate 32 can be, for example, an inorganic substrate, such as ceramic substrate, silicon-based substrate or $Al_2O_3$ based substrate, glass substrate, semiconductor related substrate (such as GaAs, InP, SiGe, GaN, AlGaN), compound substrate, organic-inorganic composition substrate, etc. The first dielectric layer 12 is made of a high dielectric material, and has a first dielectric constant. The second dielectric layer 22 has a second dielectric constant. The second dielectric constant of the second dielectric layer 22 is lower than the first dielectric constant of the first dielectric layer 12.

Figure 3:
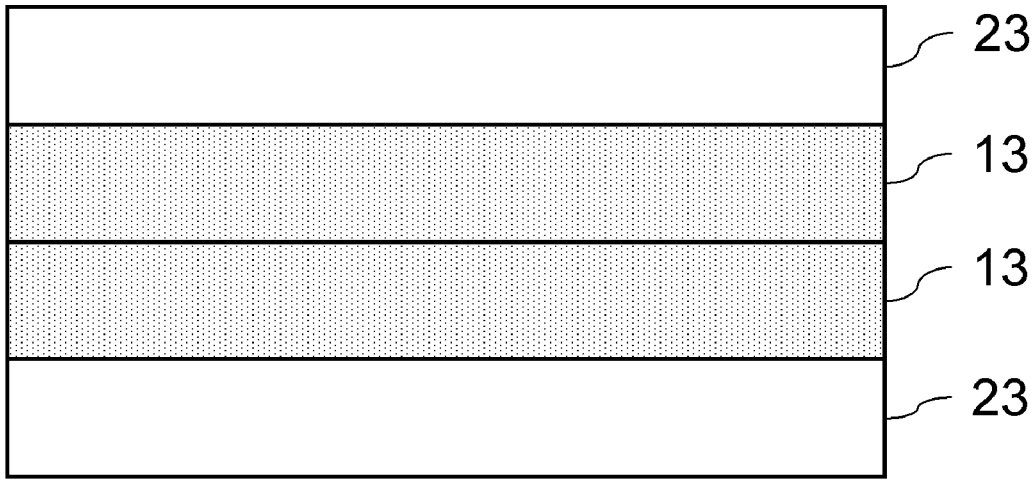
FIG. 3 is a schematic structural diagram of the high dielectric antenna substrate according to a third embodiment of the present invention.

Referring to FIG. 3, it is a schematic structural diagram of the high dielectric antenna substrate according to the third embodiment of the present invention. As shown in FIG. 3, the antenna substrate is a composite substrate including two first dielectric layers 13 and two second dielectric layers 23. The first dielectric layers 13 are made of a high dielectric material, and have a first dielectric constant respectively. One surface of each first dielectric layer 13 contacts and overlays each other. The two second dielectric layers 23, having a second dielectric constant, are formed on the other surfaces of the first dielectric layers 13 respectively. The second dielectric constant is lower than the first dielectric constant.

Figure 4:
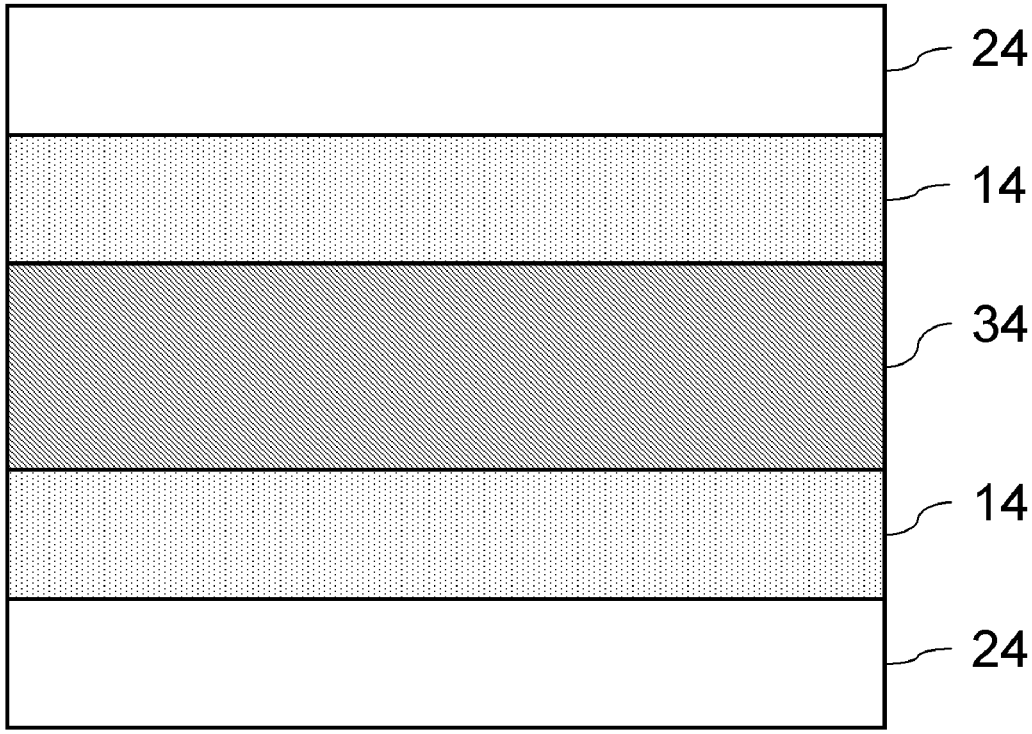
FIG. 4 is a schematic structural diagram of the high dielectric antenna substrate according to a fourth embodiment of the present invention.

Referring to FIG. 4, it is a schematic structural diagram of the high dielectric antenna substrate according to the fourth embodiment of the present invention. As shown in FIG. 4, the antenna substrate is a composite substrate including two first dielectric layers 14 and two second dielectric layers 24. The first dielectric layers 14 are made of a high dielectric material, and have a first dielectric constant respectively. The two second dielectric layers 24, having a second dielectric constant, are formed on the one surface of each first dielectric layer 14 respectively. The second dielectric constant of the second dielectric layers 24 is lower than the first dielectric constant of the first dielectric layers 14. It further comprises a substrate 34, formed between the two first dielectric layers 14. The substrate 34 can be, for example, an inorganic substrate, such as ceramic substrate, silicon-based substrate or $Al_2O_3$ based substrate, glass substrate, semiconductor related substrate (such as GaAs, InP, SiGe, GaN, AlGaN), compound substrate, organic-inorganic composition substrate, etc.

In the aforementioned four embodiments, a high dielectric material is one of the materials of which the antenna substrate is made. Therefore, when the substrate is used for the antenna design, the antenna size can be reduced, and the radiation bandwidth can be decreased. In the aforementioned four embodiments, the antenna (not shown) is disposed on a surface of the second dielectric layer. For example, in the first embodiment, the antenna is disposed on a surface of the second dielectric layer 21 that does not contact with the first dielectric layer 11.

Figure 5:
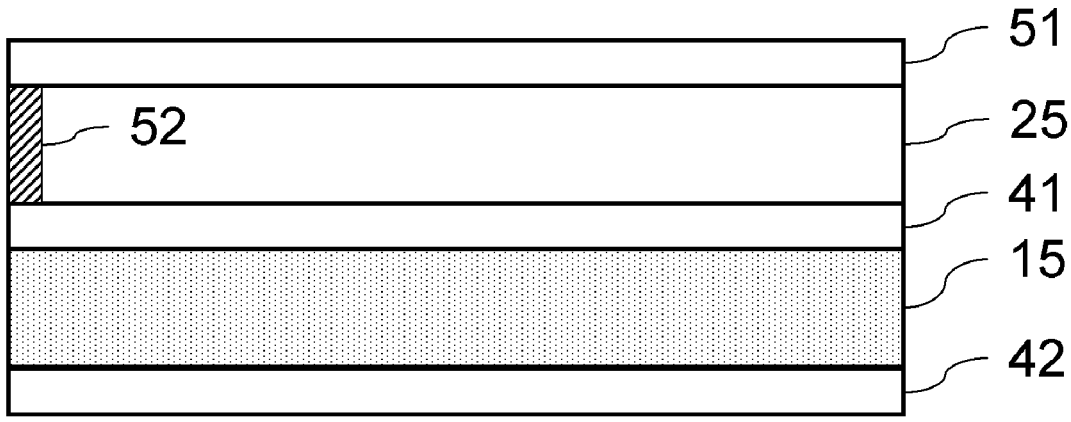
FIG. 5 is a schematic structural diagram of the high dielectric antenna substrate according to a fifth embodiment of the present invention.
Figure 6:
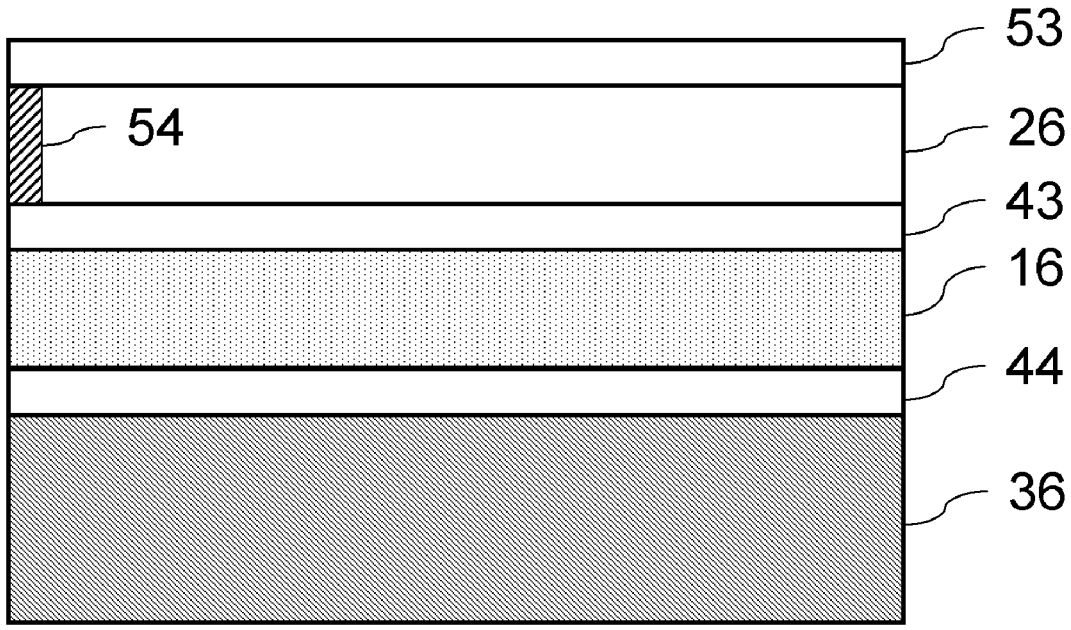
FIG. 6 is a schematic structural diagram of the high dielectric antenna substrate according to the sixth embodiment of the present invention.
Figure 7:
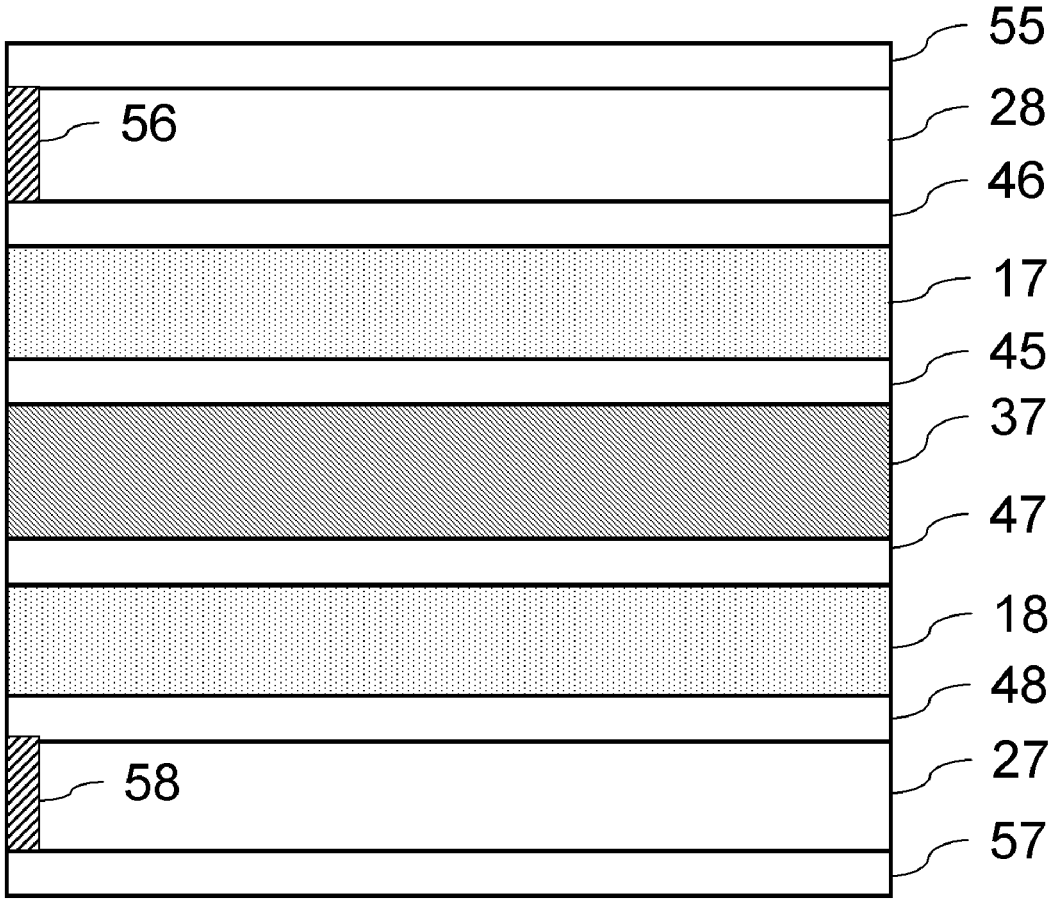
FIG. 7 is a schematic structural diagram of the high dielectric antenna substrate according to a seventh embodiment of the present invention.

To increase the radiation bandwidth of the antenna, the capacitor structure can be embedded in the structure of the aforementioned four embodiments, with reference to the illustrations of FIGS. 5 to 7.

Referring to FIG. 5, it is a schematic structural diagram of the high dielectric antenna substrate according to the fifth embodiment of the present invention. As shown in FIG. 5, the antenna substrate is a composite substrate including a first dielectric layer 15, a second dielectric layer 25, a first metal layer 41, and a second metal layer 42. The first dielectric layer 15 is made of a high dielectric material and has a first dielectric constant. The second dielectric layer 25, having a second dielectric constant, is formed on one surface of the first metal layer 41. The second dielectric constant of the second dielectric layer 25 is lower than the first dielectric constant of the first dielectric layer 15. The first metal layer 41 and the second metal layer 42 are formed on two surfaces of the first dielectric layer respectively, to compose a capacitor. In this figure, the first metal layer 41 and the second metal layer 42 substantially cover the entire substrate. In another embodiment, the first metal layer 41 and the second metal layer 42 can be designed according to the desired capacitance, without covering the entire substrate.

When the fifth embodiment of FIG. 5 is used for the antenna design, the antenna 51 is disposed on the other surface of the second dielectric layer 25, and connected with the first metal layer 41 via a through hole 52.

Referring to FIG. 6, it is a schematic structural diagram of the high dielectric antenna substrate according to the sixth embodiment of the present invention. As shown in FIG. 6, the antenna substrate is a composite substrate including a first dielectric layer 16, a second dielectric layer 26, a first metal layer 43, a second metal layer 44, and a substrate 36. The structures and compositions of the first dielectric layer 16, the second dielectric layer 26, the first metal layer 43, and the second metal layer 44 are the same as that of the fifth embodiment. The substrate 36 is formed on the other surface of the second metal layer 44. The substrate 36 can be, for example, an inorganic substrate, such as ceramic substrate, silicon-based substrate or $Al_2O_3$ based substrate, glass substrate, semiconductor related substrate (such as GaAs, InP, SiGe, GaN, AlGaN), compound substrate, organic-inorganic composition substrate, etc. The first dielectric layer 16 is made of a high dielectric material, and has a first dielectric constant. The second dielectric layer 26 has a second dielectric constant. The second dielectric constant of the second dielectric layer 26 is lower than the first dielectric constant of the first dielectric layer 16.

When the sixth embodiment of FIG. 6 is used for the antenna design, the antenna structure 53 is disposed on the other surface of the second dielectric layer 26, and is connected with the second metal layer 44 via a through hole 54.

Referring to FIG. 7, it is a schematic structural diagram of the high dielectric antenna substrate according to the seventh embodiment of the present invention. As shown in FIG. 7, the antenna substrate is a composite substrate including two first dielectric layers 17, 18, two second dielectric layers 27, 28, two first metal layers 45, 47, two second metal layers 46, 48, and a substrate 37. The first metal layer 45 and the second metal layer 46 are disposed on two surfaces of the first dielectric layer 17. The first metal layer 47 and the second metal layer 48 are disposed on two surfaces of the first dielectric layer 18. The second dielectric layer 27 is disposed on the other surface of the second metal layer 48. The second dielectric layer 28 is disposed on the other surface of the second metal layer 46. Moreover, it further comprises a substrate 37, formed between the first dielectric layers 17, 18. The substrate 37 can be, for example, an inorganic substrate, such as ceramic substrate, silicon-based substrate or $Al_2O_3$ based substrate, glass substrate, semiconductor related substrate (such as GaAs, InP, SiGe, GaN, AlGaN), compound substrate, organic-inorganic composition substrate, etc. The first dielectric layers 17, 18 are made of a high dielectric material and have a first dielectric constant. The second dielectric layers 27, 28 have a second dielectric constant. The second dielectric constant of the second dielectric layers 27, 28 is lower than the first dielectric constant of the first dielectric layers 17, 18.

When the seventh embodiment of FIG. 7 is used for the antenna design, the antenna structures 55, 57 are disposed on the other surface of the second dielectric layers 28, 27 respectively. The antenna structure 55 is connected with the second metal layer 46 via a through hole 56. The antenna structure 57 is connected with the second metal layer 48 via a through hole 58.

Figure 8:
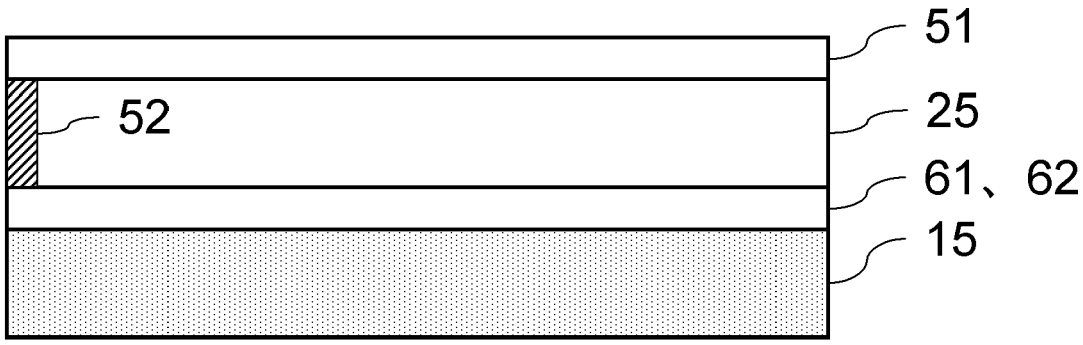
FIG. 8 is a schematic structural diagram of the high dielectric antenna substrate according to an eighth embodiment of the present invention.
Figure 9:
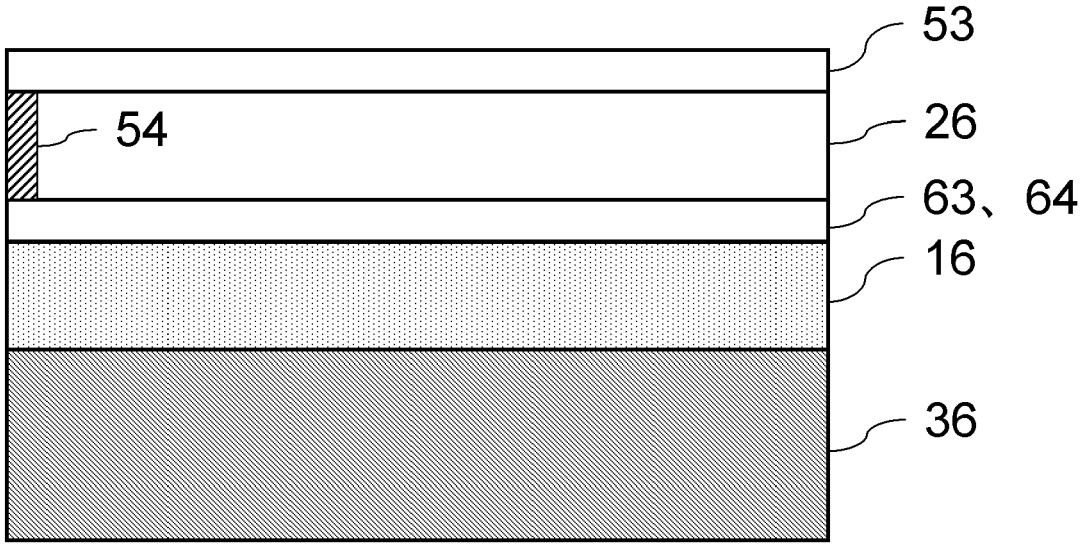
FIG. 9 is a schematic structural diagram of the high dielectric antenna substrate according to a ninth embodiment of the present invention.
Figure 10:
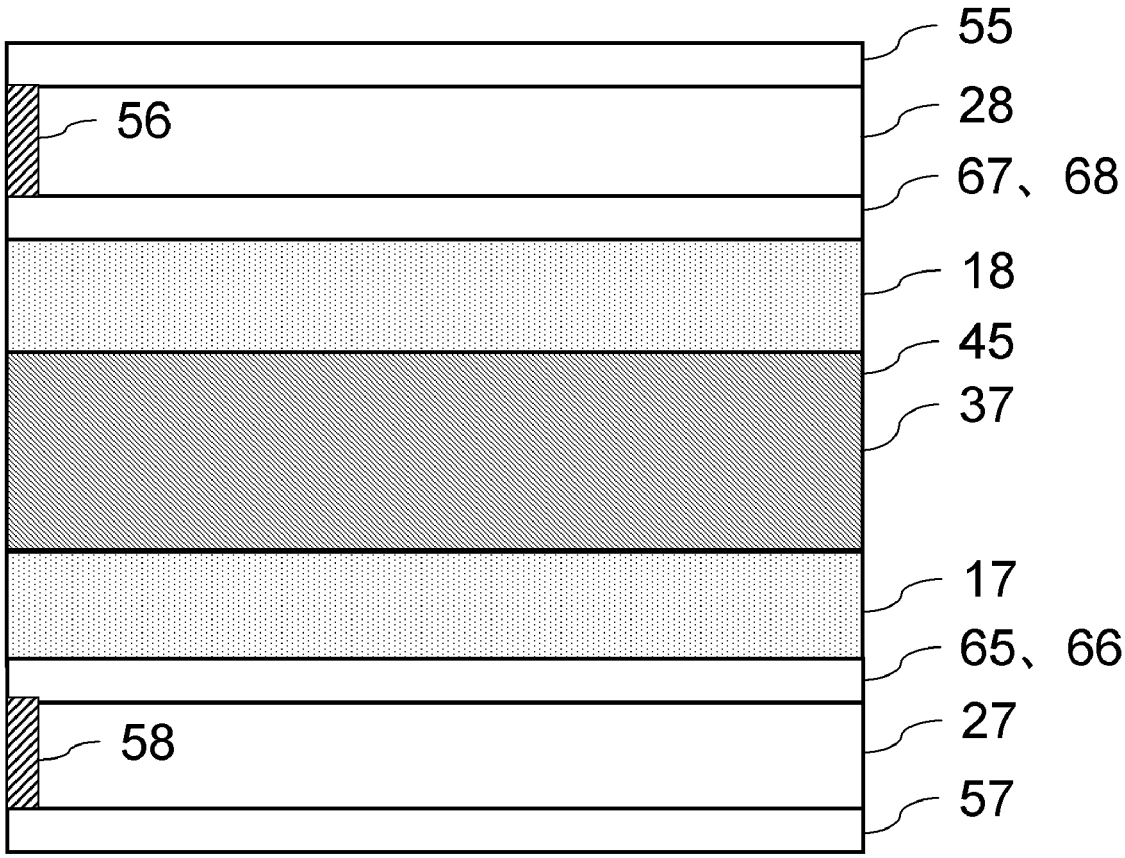
FIG. 10 is a schematic structural diagram of the high dielectric antenna substrate according to a tenth embodiment of the present invention.

In the embodiments of FIGS. 5 to 7, the first and second metal layers are disposed at two surfaces of the first dielectric layer respectively. In another embodiment, the first and second metal layers are disposed on the same surface of the first dielectric layer respectively, to compose a capacitor. The capacitor can be an interdigitated or comb capacitor. For the eighth to tenth embodiments shown in FIGS. 8-10, the first metal layer 61 and the second metal layer 62, the first metal layer 63 and the second metal layer 64, the first metal layer 65 and the second metal layer 66, the first metal layer 67 and the second metal layer 68 are disposed on the same surface of the first dielectric layers 15, 16, 17, 18 respectively. The structures and compositions of the embodiments shown in FIGS. 8 to 10 are the same as which of the embodiments shown in FIGS. 5 to 7, except that the first metal layer and the second metal layer are disposed on the same surface of the first dielectric layers. Similarly, referring to FIG. 9, the substrate 36 is formed on the other surface of the first dielectric layer 16. The substrate 36 can be, for example, an inorganic substrate, such as ceramic substrate, silicon-based substrate or $Al_2O_3$ based substrate, glass substrate, semiconductor related substrate (such as GaAs, InP, SiGe, GaN, AlGaN), compound substrate, organic-inorganic composition substrate, etc.

Figure 11A:
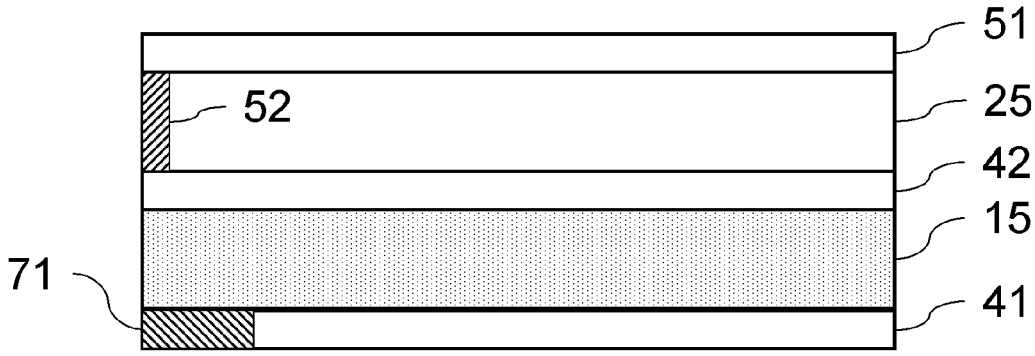
FIGS. 11A to 11B are schematic structural diagrams of the high dielectric antenna substrate according to an eleventh embodiment of the present invention.
Figure 11B:
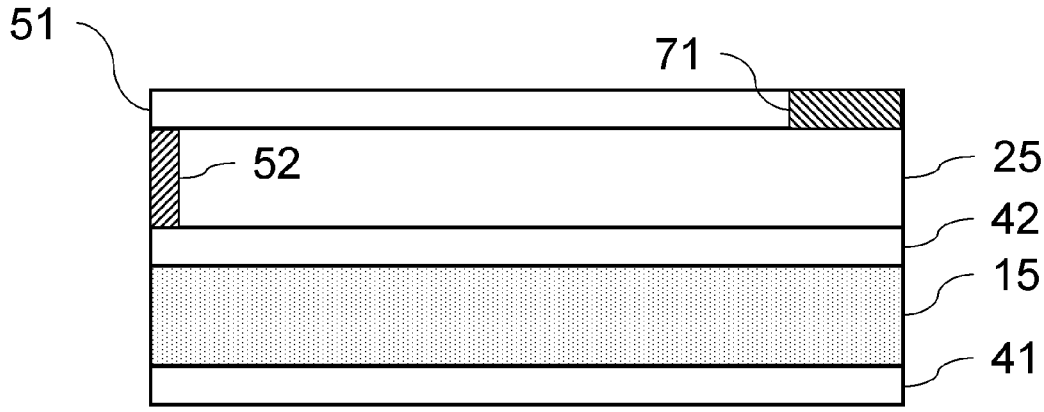
Figure 12:
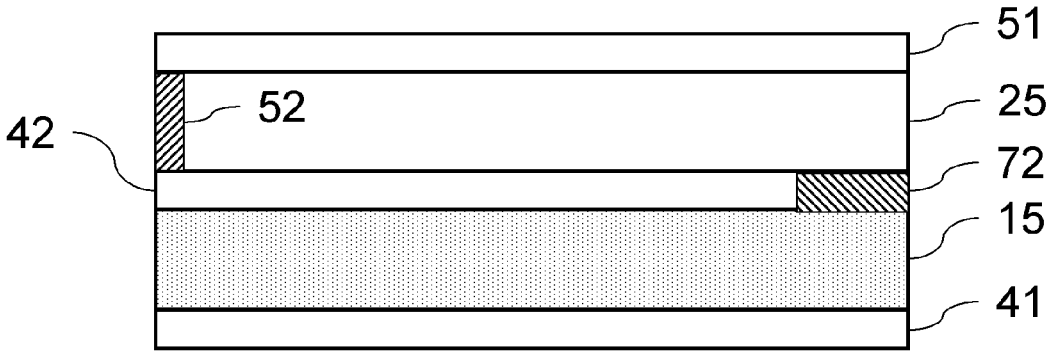
FIG. 12 is a schematic structural diagram of the high dielectric antenna substrate according to a twelfth embodiment of the present invention.

Referring to FIG. 11A, it shows the eleventh embodiment of the present invention. Corresponding to the fifth embodiment shown in FIG. 5, an inductor 71 is optionally connected in series with a capacitor composed by the first metal layer 41 and the second metal layer 42. In the eleventh embodiment, the inductor 71 is connected with the first metal layer 41. In the twelfth embodiment shown in FIG. 12, the inductor 72 is connected with the second metal layer 42. Although the inductor is connected with the first metal layer, the inductor also can be connected with the antenna in another embodiment, as shown in FIG. 11B, the inductor 71 is connected with the antenna 51. The structures and compositions of the embodiments shown in FIGS. 11A, 11B, and 12 are the same as which of the embodiments shown in FIG. 5, except that the inductor can be connected with one of the first metal layer, the second metal layer and the antenna.

Figure 13A:
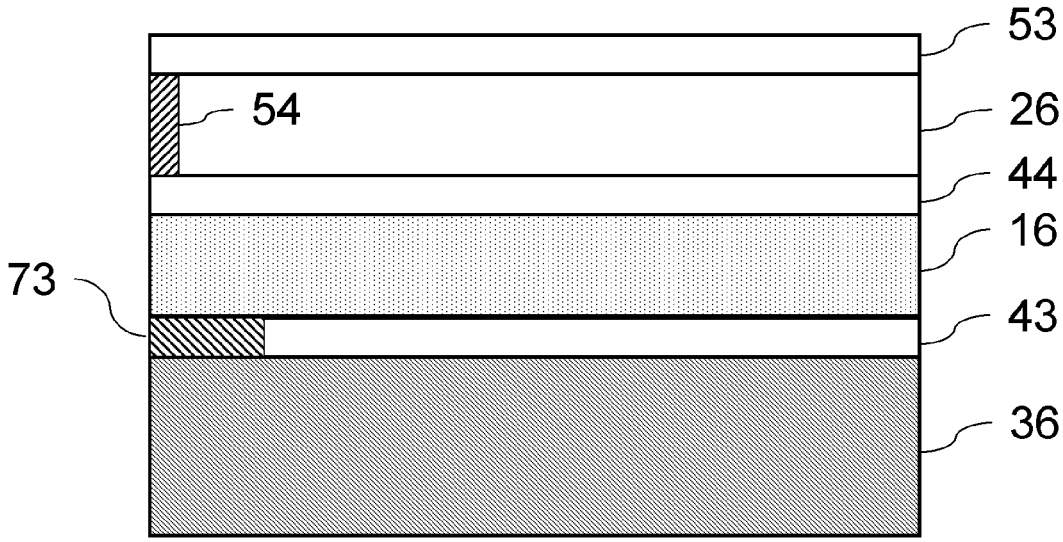
FIG. 13A to 13B are schematic structural diagrams of the high dielectric antenna substrate according to a thirteenth embodiment of the present invention.
Figure 13B:
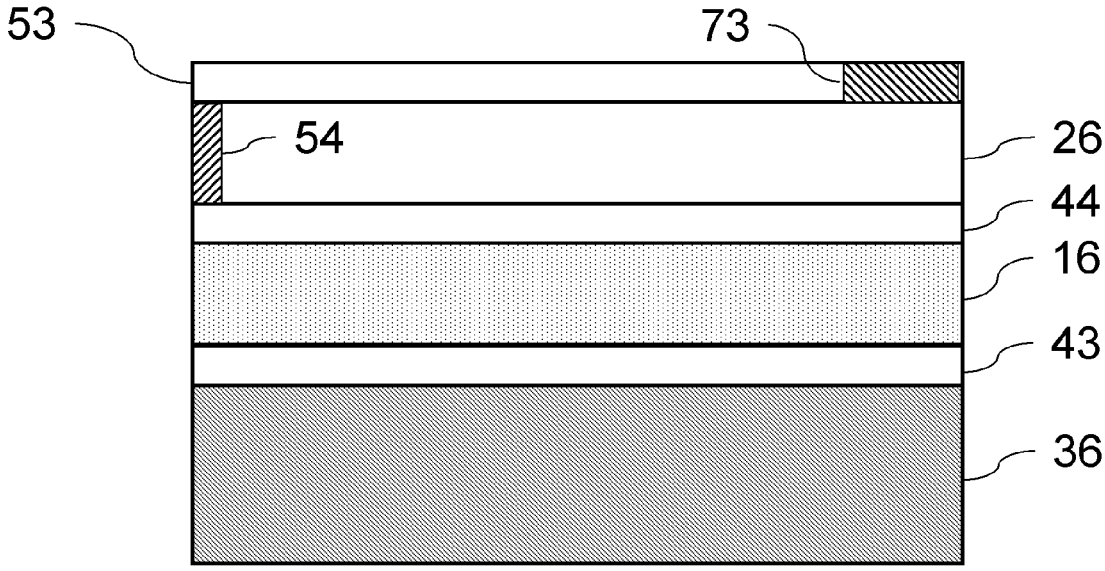
Figure 14:
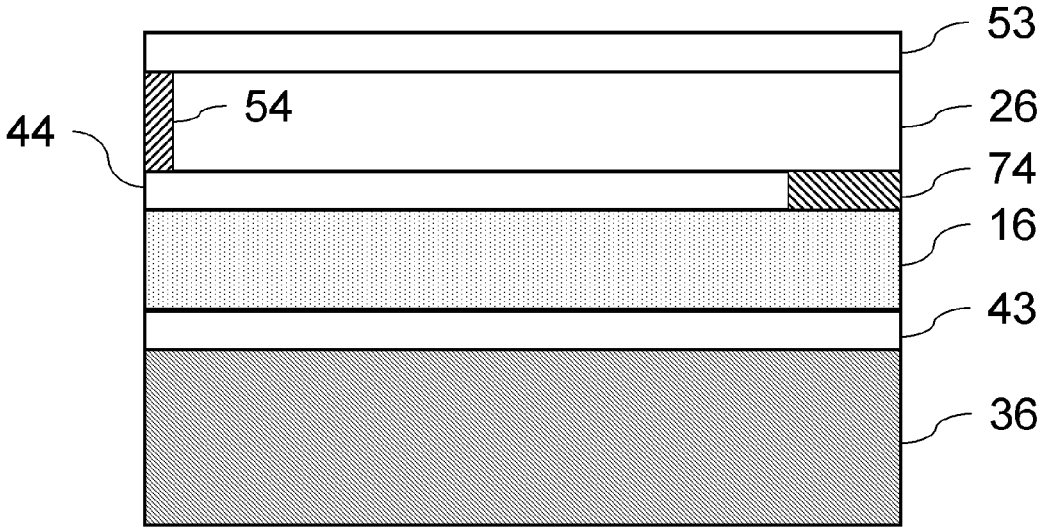
FIG. 14 is a schematic structural diagram of the high dielectric antenna substrate according to a fourteenth embodiment of the present invention.

Referring to FIG. 13A, it shows the thirteenth embodiment of the present invention. Corresponding to the sixth embodiment shown in FIG. 6, an inductor 73 is optionally connected in series with a capacitor composed by the first metal layer 43 and the second metal layer 44. In the thirteenth embodiment, the inductor 73 is connected with the first metal layer 43. In the fourteenth embodiment shown in FIG. 14, the inductor 74 is connected with the second metal layer 44. Although the inductor is connected with the first metal layer, the inductor also can be connected with the antenna in another embodiment, as shown in FIG. 13B, the inductor 73 is connected with the antenna 53. The structures and compositions of the embodiments shown in FIGS. 13A, 13B, and 14 are the same as which of the embodiments shown in FIG. 6, except that the inductor can be connected with one of the first metal layer, the second metal layer and the antenna.

Figure 15A:
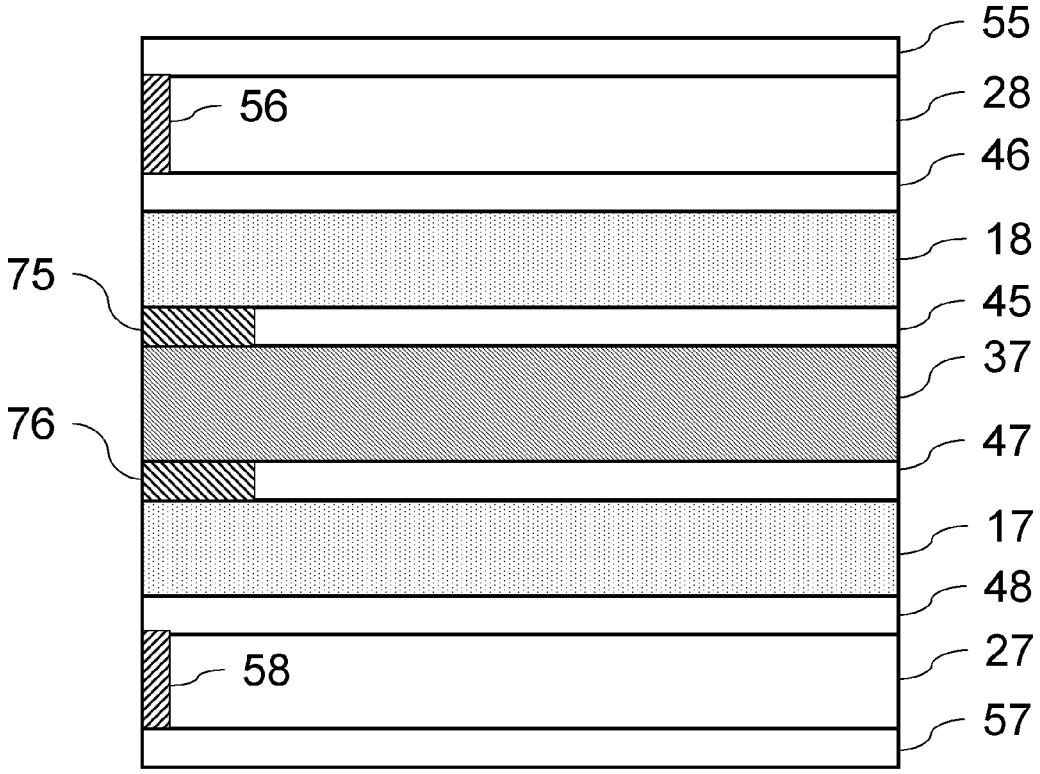
FIGS. 15A to 15B are schematic structural diagrams of the high dielectric antenna substrate according to a fifteenth embodiment of the present invention.
Figure 15B:
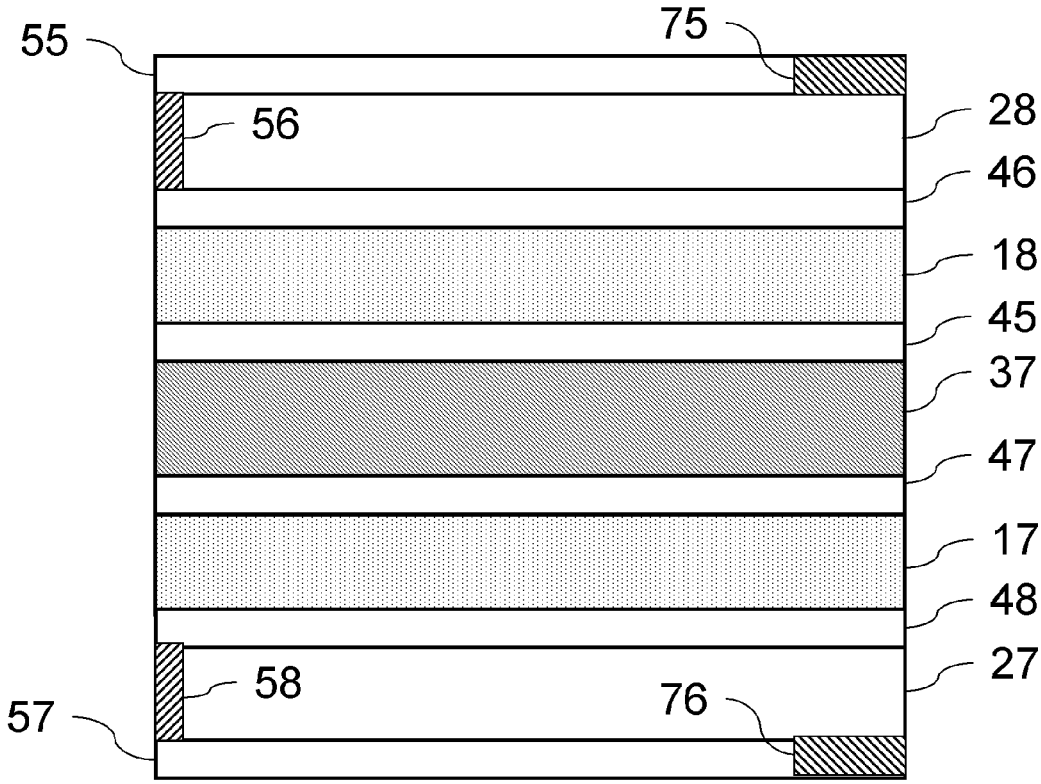
Figure 16:
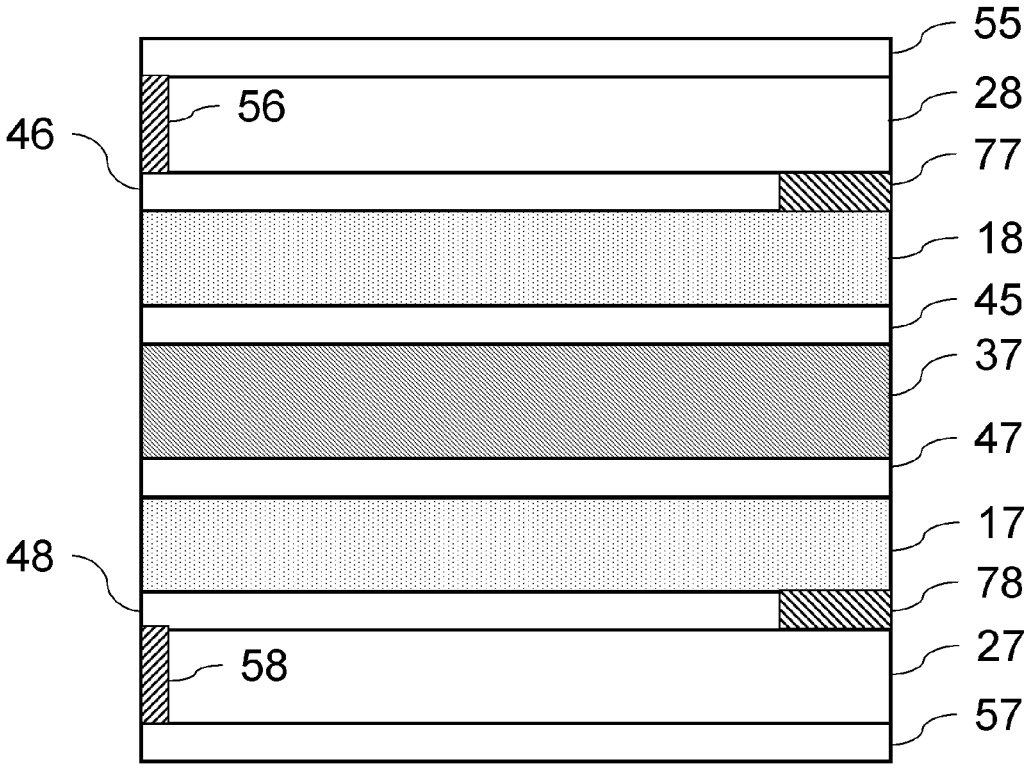
FIG. 16 is a schematic structural diagram of the high dielectric antenna substrate according to a sixteenth embodiment of the present invention.

Referring to FIG. 15A, it shows the fifteenth embodiment of the present invention. Corresponding to the seventh embodiment shown in FIG. 7, an inductor 75 is connected in series with the capacitors composed by the first metal layer 45 and the second metal layer 46, and an inductor 76 is connected in series with the capacitors composed by the first metal layer 47 and the second metal layer 48. In the fifteenth embodiment, the inductor 75 is connected with the first metal layer 45, and the inductor 76 is connected with the first metal layer 47. Similarly, referring to FIG. 15B, the inductor 75 is connected with the antenna 55, and the inductor 76 is connected with the antenna 57. In the sixteenth embodiment shown in FIG. 16, the inductor 77 is connected with the second metal layer 46, and the inductor 78 is connected with the second metal layer 48. The inductors 75, 76, 77, and 78 can be optionally disposed depending on the circuit, without necessarily being disposed together, e.g., the inductors 75 and 77, the inductors 75 and 78, the inductors 76 and 77, or the inductors 76 and 78 can be disposed together, and they can be combined with one another depending on the circuit requirements. The structures and compositions of the embodiments shown in FIGS. 15A, 15B, and 16 are the same as which of the embodiments shown in FIG. 7, except that the inductors can be optionally connected with two of the first metal layers, the second metal layers and the antennas.

Figure 17:
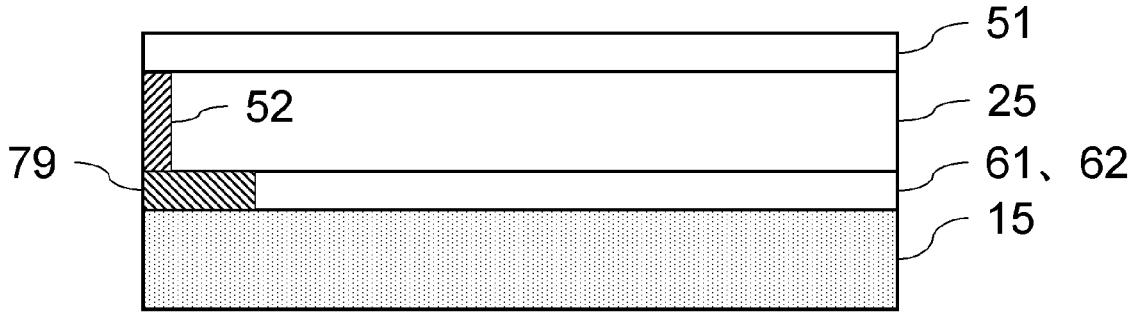
FIG. 17 is a schematic structural diagram of the high dielectric antenna substrate according to a seventeenth embodiment of the present invention.
Figure 18:
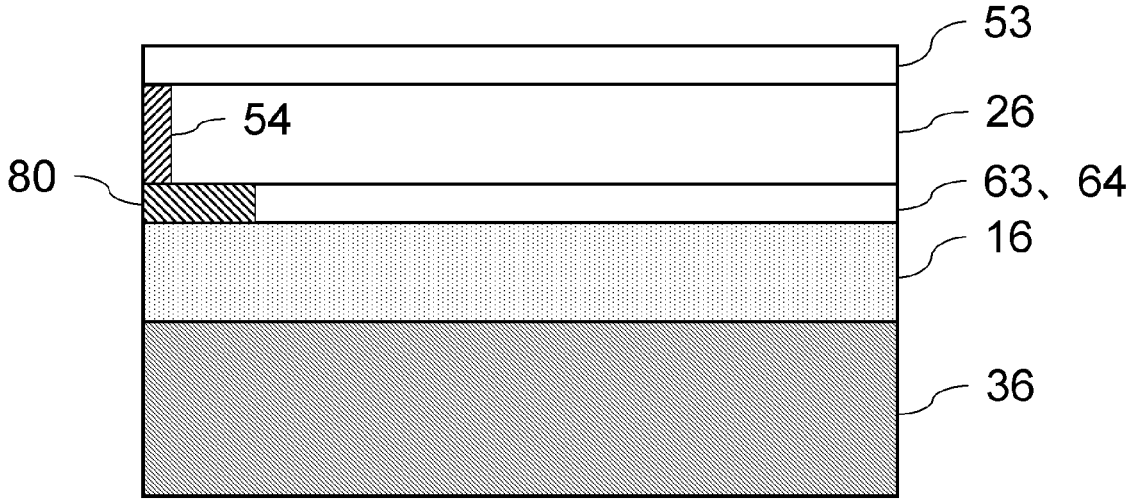
FIG. 18 is a schematic structural diagram of the high dielectric antenna substrate according to an eighteenth embodiment of the present invention.
Figure 19:
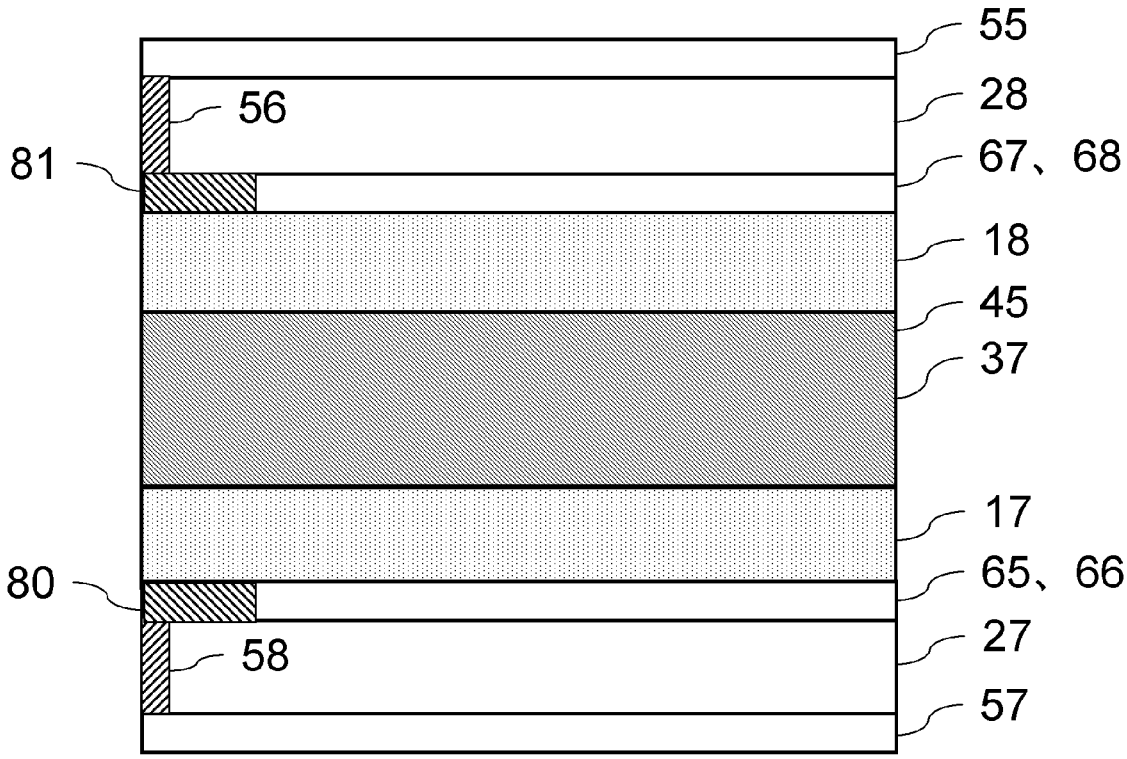
FIG. 19 is a schematic structural diagram of the high dielectric antenna substrate according to a nineteenth embodiment of the present invention.

In the embodiments of FIGS. 8 to 10, the first metal layer 61 and the second metal layer 62 also can be optionally connected in series with an inductor 79; the first metal layer 63 and the second metal layer 64, the first metal layer 65 and the second metal layer 66 also can be optionally connected in series with an inductor 80; and the first metal layer 67 and the second metal layer 68 also can be optionally connected in series with an inductor 81, referring to the seventeenth to nineteenth embodiments of FIGS. 17 to 19.

Figure 20:
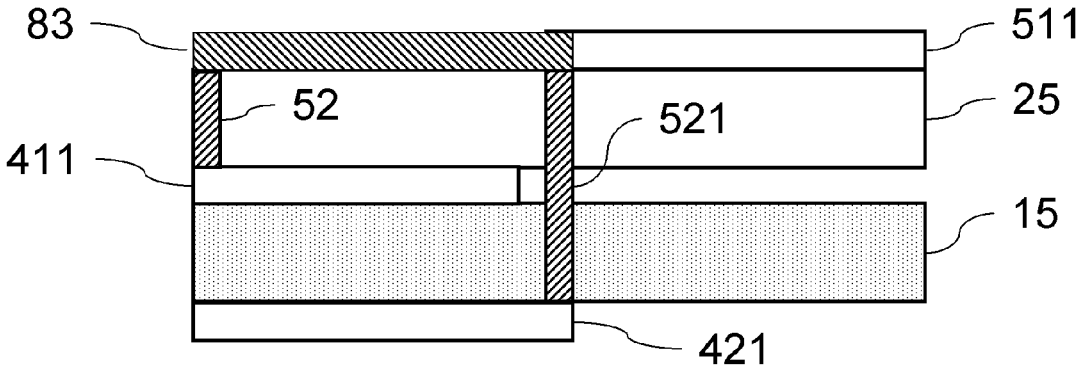
FIG. 20 is a schematic structural diagram of the high dielectric antenna substrate according to a twentieth embodiment of the present invention.

Referring to FIG. 20, it shows the twentieth embodiment of the present invention. Corresponding to the fifth embodiment shown in FIG. 5, an inductor 83 is optionally connected in parallel with a capacitor composed by the first metal layer 411 and the second metal layer 421. In this embodiment, the through-hole 52 connects the inductor 83 to the first metal layer 411, and the through hole 521 connects the inductor 83 to the second metal layer 421, to form a parallel connection. The antenna 511 is connected with the inductor 83.

Figure 21:
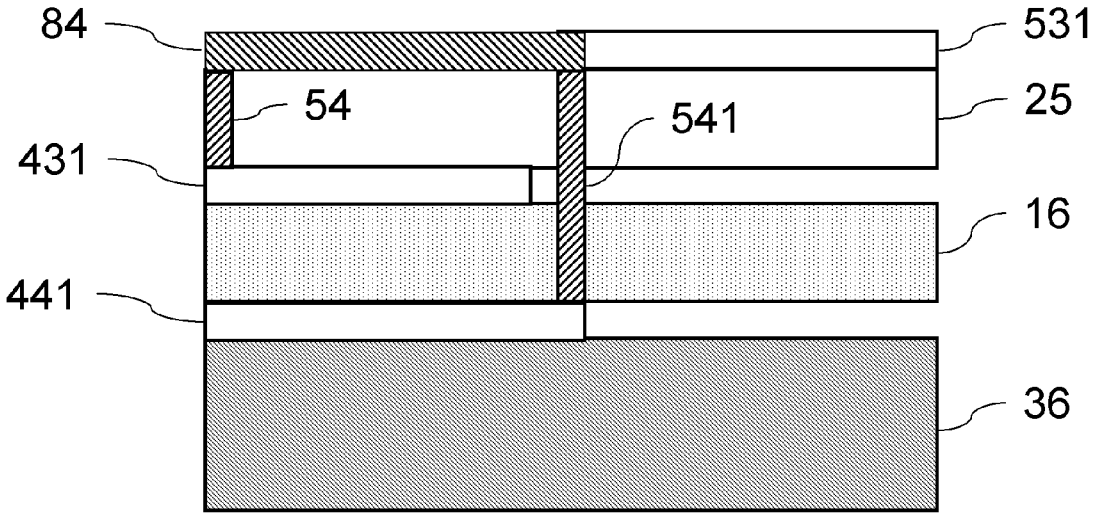
FIG. 21 is a schematic structural diagram of the high dielectric antenna substrate according to a twenty-first embodiment of the present invention.

Referring to FIG. 21, it shows a twenty-first embodiment of the present invention. Corresponding to the sixth embodiment shown in FIG. 6, an inductor 84 is optionally connected in parallel with a capacitor composed by the first metal layer 431 and the second metal layer 441. In the embodiment, the through-hole 54 connects the inductor 84 to the first metal layer 431, and the through-hole 541 connects the inductor 84 to the second metal layer 441, to form a parallel connection. The antenna 531 is connected with the inductor 84.

Figure 22:
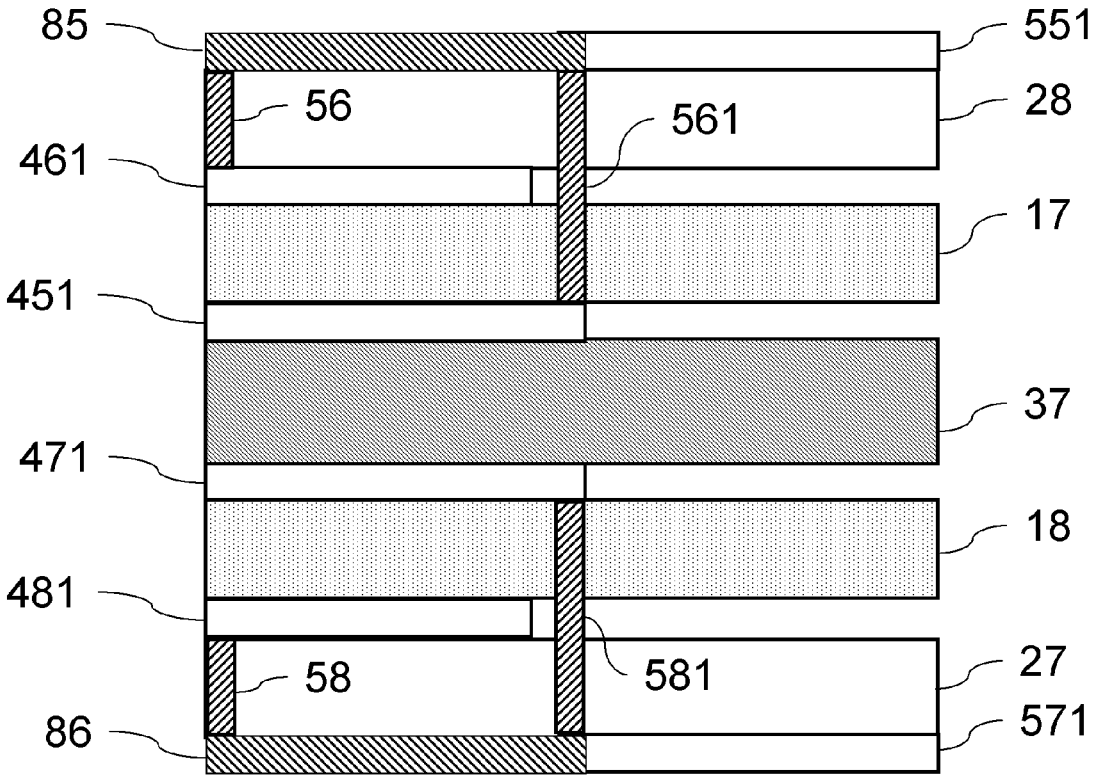
FIG. 22 is a schematic structural diagram of the high dielectric antenna substrate according to a twenty-second embodiment of the present invention.

Referring to FIG. 22, it shows a twenty-second embodiment of the present invention. The antenna substrate is a composite substrate including two first dielectric layers 17, 18, two second dielectric layers 27, 28, two first metal layers 451, 471, two second metal layers 461, 481, and a substrate 37. The first metal layer 451 and the second metal layer 461 are disposed on two surfaces of the first dielectric layer 17. The first metal layer 471 and the second metal layer 481 are disposed at two surfaces of the first dielectric layer 18. The inductor 85 is optionally connected in parallel with a capacitor composed by the first metal layer 451 and the second metal layer 461, and the inductor 86 is optionally connected in parallel with a capacitor composed by the first metal layer 471 and the second metal layer 481. In this embodiment, the through hole 56 connects the inductor 85 to the second metal layer 461, and the through hole 561 connects the inductor 85 to the first metal layer 451, to form a parallel connection. The through hole 58 connects the inductor 86 to the second metal layer 481, and the through hole 581 connects the inductor 86 to the first metal layer 471, to form a parallel connection. The antenna 551 is connected with the inductor 85, and the antenna 571 is connected with the inductor 86. In all of the above-mentioned embodiments, the second dielectric layer may further support the substrate and the first dielectric layer.

According to the embodiments of the present invention, the antenna substrate is made of composite material by stamping, and contains a high dielectric material, for designing an embedded capacitor. The embedded capacitor can provide a resonance frequency, a matching circuit, and increase the radiation efficiency. Furthermore, with the high dielectric material, the antenna size can be reduced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A high dielectric antenna substrate, comprising:

a first dielectric layer, having a first dielectric constant; and a second dielectric layer, having a second dielectric constant, formed on one surface of the first dielectric layer, wherein the second dielectric constant is lower than the first dielectric constant; and a substrate formed on the other surface of the first dielectric layer, wherein the substrate is an inorganic material substrate.

2. A high dielectric antenna substrate, comprising:

two first dielectric layers, having a first dielectric constant respectively, wherein one surface of each first dielectric layer contacts with each other; and two second dielectric layers, having a second dielectric constant, formed on one surface of each first dielectric layer respectively, wherein the second dielectric constant is lower than the first dielectric constant;

a substrate formed between the two first dielectric layers, wherein the substrate is an inorganic material substrate.

3. The antenna substrate as claimed in claim 2, wherein the second dielectric layer supports the substrate and the first dielectric layer.

4. A high dielectric antenna substrate, comprising:

a first dielectric layer, having a first dielectric constant;

a first metal layer and a second metal layer, formed on two surfaces of the first dielectric layer respectively, to compose a capacitor;

a second dielectric layer, having a second dielectric constant, formed on one surface of the first metal layer, wherein the second dielectric constant is lower than the first dielectric constant; and a substrate, formed on the other surface of the first metal layer, wherein the substrate is an inorganic material substrate.

5. A high dielectric antenna substrate, comprising:

a first dielectric layer, having a first dielectric constant;

a first metal layer and a second metal layer, formed on the same surface of the first dielectric layer, to compose a capacitor;

a second dielectric layer, having a second dielectric constant, formed on one surface of the first metal layer, wherein the second dielectric constant is lower than the first dielectric constant; and a substrate, formed on the other surface of the first dielectric layer, wherein the substrate is an inorganic material substrate.

6. The antenna substrate as claimed in claim 5, wherein the second dielectric layer supports the substrate and the first dielectric layer.

7. A high dielectric antenna substrate, comprising:

two first dielectric layers, having a first dielectric constant respectively;

two first metal layers and two second metal layers, wherein one of the first metal layers and one of the second metal layers are formed on two surfaces of one of the first dielectric layers, to compose a capacitor; and the other one of the first metal layers and the other one of the second metal layers are formed on two surfaces of the other one of the first dielectric layers, to compose a capacitor;

two second dielectric layers, having a second dielectric constant, formed on the other surface of the second metal layer respectively, wherein the second dielectric constant is lower than the first dielectric constant; and a substrate, formed between the two first dielectric layers, wherein the substrate is an inorganic material substrate.

8. The antenna substrate as claimed in claim 7, wherein the second dielectric layer supports the substrate and the first dielectric layer.

9. A high dielectric antenna substrate, comprising:

two first dielectric layers, having a first dielectric constant respectively;

two first metal layers and two second metal layers, wherein one of the first metal layers and one of the second metal layers are formed on the same surface of one of the first dielectric layers, to compose a capacitor; and the other one of the first metal layers and the other one of the second metal layers are formed on the same surface of the other one of the first dielectric layers, to compose a capacitor;

two second dielectric layers, having a second dielectric constant, formed on the other surface of the second metal layer respectively, wherein the second dielectric constant is lower than the first dielectric constant; and a substrate, formed between the two first dielectric layers, wherein the substrate is an inorganic material substrate.

10. The antenna substrate as claimed in claim 9, wherein the second dielectric layer supports the substrate and the first dielectric layer.

11. An antenna module, comprising:

a first dielectric layer, having a first dielectric constant;

a second dielectric layer, having a second dielectric constant, formed on one surface of the first dielectric layer, wherein the second dielectric constant is lower than the first dielectric constant;

an antenna, formed on the other surface of the second dielectric layer; and a substrate, formed on the other surface of the first dielectric layer, wherein the substrate is an inorganic material substrate.

12. The antenna module as claimed in claim 11, wherein the second dielectric layer supports the substrate and the first dielectric layer.

13. An antenna module, comprising:

two first dielectric layers, having a first dielectric constant respectively;

two second dielectric layers, having a second dielectric constant, wherein the second dielectric constant is lower than the first dielectric constant;

at least one antenna, formed on one surface of each second dielectric layer; and a substrate, formed between the two first dielectric layers, wherein the substrate is an inorganic material substrate.

14. The antenna module as claimed in claim 13, wherein the second dielectric layer supports the substrate and the first dielectric layer.

15. An antenna module, comprising:

a first dielectric layer, having a first dielectric constant;

a first metal layer and a second metal layer, formed on two surfaces of the first dielectric layer respectively, to compose a capacitor;

a second dielectric layer, having a second dielectric constant, formed on one surface of the first metal layer, wherein the second dielectric constant is lower than the first dielectric constant;

an antenna, formed on the other surface of the second dielectric layer; and a substrate, formed on the other surface of the second metal layer, wherein the substrate is an inorganic material substrate.

16. The antenna module as claimed in claim 15, wherein the second dielectric layer supports the substrate and the first dielectric layer.

17. The antenna module as claimed in claim 15, further comprising an inductor disposed on the same surface of the first dielectric layer as the first metal layer, and connected with the first metal layer.

18. The antenna module as claimed in claim 15, further comprising an inductor disposed on the same surface of the first dielectric layer as the second metal layer, and connected with the second metal layer.

19. The antenna module as claimed in claim 15, further comprising an inductor disposed on the other surface of the second dielectric layer, and connected with the antenna.

20. An antenna module, comprising:

two first dielectric layers, having a first dielectric constant respectively;

two first metal layers and two second metal layers, wherein one of the first metal layers and one of the second metal layers are formed on two surfaces of one of the first dielectric layers, to compose a capacitor; and the other one of the first metal layers and the other one of the second metal layers are formed on two surfaces of the other one of the first dielectric layers, to compose a capacitor;

two second dielectric layers, having a second dielectric constant, formed on the other surface of the second metal layer respectively, wherein the second dielectric constant is lower than the first dielectric constant;

a substrate, formed between the two first metal layers, wherein the substrate is an inorganic material substrate; and at least one antennas, formed on the other surface of the second dielectric layer.

21. The antenna module as claimed in claim 20, further comprising an inductor disposed at the same surface of the first dielectric layer as one of the first metal layers, and connected with the first metal layer.

22. The antenna module as claimed in claim 20, wherein the second dielectric layer supports the substrate and the first dielectric layer.

23. The antenna module as claimed in claim 20, further comprising two inductors respectively disposed at the same surface of the first dielectric layer as the first metal layer, and connected with first metal layer.

24. The antenna module as claimed in claim 20, further comprising an inductor disposed at the same surface of the first dielectric layer as one of the second metal layers, and connected with the second metal layer.

25. The antenna module as claimed in claim 20, further comprising two inductors disposed on the same surface of the first dielectric layer as the second metal layer, and connected with the second metal layer.

26. The antenna module as claimed in claim 20, further comprising an inductor formed on the other surface of one of the second dielectric layers, and connected with one of the antennas.

27. The antenna module as claimed in claim 20, further comprising an inductor formed on the other surface of the second dielectric layers respectively, and connected with the antennas respectively.

* * * * *